US005760667A

United States Patent [19]

Young et al.

[11] Patent Number: 5,760,667

[45] Date of Patent: Jun. 2, 1998

[54] NON-UNIFORM Q SELF AMPLITUDE EQUALIZED BANDPASS FILTER

[75] Inventors: Frederick A. Young, Huntington Beach; Richard L. Bennett, Torrance; Keith N. Loi, Rosemead, all of Calif.

[73] Assignee: Hughes Aircraft Co., Los Angeles, Calif.

[21] Appl. No.: 501,595

[22] Filed: Jul. 12, 1995

[51] Int. Cl.[6] ..... H01P 1/208; H01P 7/06

[52] U.S. Cl. ..... 333/212; 333/219; 333/230

[58] Field of Search ..... 333/202, 208, 333/209, 212, 219, 227, 230, 231, 235

[56] References Cited

U.S. PATENT DOCUMENTS

| | | | |
|---|---|---|---|
| 4,060,779 | 11/1977 | Atia et al. | 333/212 |
| 4,241,323 | 12/1980 | Griffin et al. | 333/209 |
| 5,254,963 | 10/1993 | Bonetti et al. | 333/208 |

FOREIGN PATENT DOCUMENTS

| | | | |
|---|---|---|---|
| 2238828 | 3/1991 | United Kingdom | 333/208 |

OTHER PUBLICATIONS

Williams et al., "Dual-Mode Canonical Waveguide Filters," *IEEE Transactions on Microwave Theory and Techniques*, vol. MTT-25, No. 12, Dec. 1977, pp. 1021-1026.

Temes et al. *Modern Filter Theory and Design*, John Wiley & Sons, 1973, pp. 84-91 no month.

*Primary Examiner*—Benny T. Lee

*Assistant Examiner*—Justin P. Bettendorf

*Attorney, Agent, or Firm*—Elizabeth E. Leitereg; Wanda K. Denson-Low; Terje Gudmestad

[57] ABSTRACT

A bandpass filter having 4-degrees of freedom includes a plurality of resonant cavities having respective Qs where at least one of the Qs is different. A plurality of main couplings couple successive resonant cavities to establish a main signal path that provides a first degree of freedom for controlling the shape of the filter's frequency response over its passband. A plurality of bridge couplings couple pairs of the resonant cavities so that the cavities are connected in a canonical circuit topology. The bridge couplings provide second and third degrees of freedom for controlling the sharpness of the frequency response 's transition between its passband and stopband and controlling the linearity of its phase, respectively. The cavities' non-uniform Qs provide a fourth degree of freedom for controlling the amplitude of the filter's frequency response in the passband so that the amplitude is within a predetermined tolerance of a desired passband shape.

12 Claims, 4 Drawing Sheets

NON-UNIFORM Q SELF AMPLITUDE EQUALIZED BANDPASS FILTER

BACKGROUND OF THE INVENTION

1. Field of the Invention

The present invention generally relates to electromagnetic (EM) resonant cavity bandpass filters, and more specifically to a bandpass filter that has non-uniform Q resonant cavities which provide a fourth degree of freedom for performing amplitude equalization of the filter's passband.

2. Description of the Related Art

EM resonant cavity bandpass filters are used in communication systems such as the satellite system 10 shown in FIG. 1. The satellite 10 includes an antenna 12 that picks up a broadband signal 14, typically a bandwidth of 500 MHz, transmitted from earth and a receiver 16 that amplifies signal 14. A bank of bandpass filters 18, each centered at a different center frequency $f_0$ and having a passband of suitably 36 MHz, split the broadband signal into a number of narrowband signals 20. A plurality of transponders 22 beam the respective narrowband signals 20 back to different points on earth.

Each bandpass filter 18 has a frequency response 24 that includes a magnitude response 26 and a phase response 28 as shown in FIG. 2. Ideally, the magnitude response would have unity amplitude in the passband 29 and zero amplitude in the stopband 30 and the phase response would be perfectly linear. This would minimize the distortion in the individual narrow band signals and would allow them to be packed very close together thereby conserving bandwidth. In general, the preferred shape of the frequency response 24 is controlled by, in order of importance, 1) the order n of the filter which controls the sharpness of the magnitude response 26: that is how long the amplitude remains close to unity over the passband 29 and how fast the amplitude approaches zero in the stopband 30, 2) the number 1 of finite frequency loss poles which increase the sharpness of the amplitude transition from passband to stopband and produce an equiripple effect in the stopband, 3) the number m of self delay equalization poles which linearize the phase response 28 in the passband 29, and 4) the number k of self amplitude equalization zeros that occur in and produce an equiripple effect in the passband that reduce distortion in the passband. These four parameters are commonly known as the 4-degrees of freedom (n,l,m,k) of the bandpass filter 18.

Bandpass filters 18 having 3-degrees of freedom are commonly implemented with a canonical circuit topology as shown in FIG. 3. G. Temes and S. Mitra, "Modern Filter Theory and Design," John Wiley & Sons, Inc., pp.84–91, 1973 present the principles of the canonical circuit topology which are well known in the field of EM resonant cavity bandpass filter design and implementation. The canonical circuit topology's 3-degrees of freedom are allocated to the n, 1 and m parameters to achieve optimum frequency and phase response. U.S. Pat. No. 4,241,323 "Reflective Dual Mode Filter," assigned to Hughes Aircraft Company, the assignee of the present invention, discloses a dual-mode filter that allows a direct realization of all canonical couplings to provide 3-degrees of freedom.

The bandpass filter 18 includes n fixed Q resonant cavities 32, which can be implemented as n resonators or the first degree of freedom. Q is the quality factor of the filter and is defined as the ratio of energy stored per cycle divided by the energy dissipated per cycle. The resonant cavities are designed to have the same optimum Q to minimize ohmic loss and improve power efficiency. The "optimum" Q is selected to be a very high value, for example 12,000, that can be practically implemented. Qs larger than the optimum could be realized but the size and weight of the cavities would not be practical. In communication systems, and for satellites in particular, the filter's power dissipation efficiency is very important.

The resonant cavities 32 are coupled in succession through main couplings 34, which are implemented as apertures whose size and shape determine the bandwidth of the bandpass filter. The broadband signal 14 is input coupled to the bandpass filter 18 through an input port 36, propagates electromagnetically in a first mode through the first n/2 cavities, reflects off the back wall of the n/2 cavity, propagates in a second mode that is generally orthogonal to the first mode through the remaining n/2 cavities, and is output coupled through an output port 38. Pairs of resonant cavities 32 (adjacent resonators in a single-mode filter or the same resonator in a dual-mode filter) are also coupled by bridge couplings 40 which perturb the impedance of the cavities so that the first and second modes are not orthogonal. The cross-coupling of the modes produces the finite frequency loss poles and self delay equalization poles. The bridge couplings are suitably implemented with screws and provide both the second and third degrees of freedom.

The values for n, 1 and m for a particular application are selected using a numerical optimization program. The center frequency $f_0$, bandwidth $\Delta f$, the stopband tolerance 42 (shown in FIG. 2), the return loss tolerance (power reflected by the cavity), the phase linearity tolerance 44 and the optimum fixed Q are provided as inputs to the program. The number of resonant cavities n and the number of bridge couplings 1, m are variables. The program generates the number of resonant cavities n and the number of bridge couplings 1 and m and their respective coupling values that optimize the frequency response for the given design requirement parameters. The canonical circuit topology dictates where the bridge couplings are positioned depending on their respective values. The bridge couplings (screws) are adjusted to realize the amount of coupling computed by the program.

The common cavity geometry (size, volume, cross-section) is uniquely determined by the selection of the optimum fixed Q, the center frequency $f_0$ and the bandwidth $\Delta f$. The cavities' walls are lined with silver plating to provide maximum conductivity to realize the optimum Q and reduce their physical size. In satellites, the filters' size, and correspondingly, weight are additional important factors that should be reduced when designing the filter. The apertures that provide the main couplings between the cavities are selected to provide the desired filter bandwidth $\Delta f$.

To provide the fourth degree of freedom for external amplitude equalization, an external amplitude equalizer 46 is connected to the 3-degree of freedom bandpass filter 18 as shown in FIG. 4. The amplitude equalizer 46 is suitably implemented by using a ferrite isolator and a two-resonator external reflection type amplitude equalizer. The amplitude equalizer is designed separately from the bandpass filter using a similar optimization program. The desired amplitude tolerance 47 (shown in FIG. 2) and design of the bandpass filter are provided as inputs to the program, which in turn solves for the required number of zeros in the passband. The addition of the amplitude equalizer significantly increases the size and weight of the bandpass filter 18, increases insertion losses such as passband frequency dispersion, and increases the overall cost of the system. In many cases, the improvement in the passband amplitude does not justify the increase in size, weight and cost, and thus the inferior 3-degree of freedom implementation is used.

SUMMARY OF THE INVENTION

The present invention seeks to provide a self amplitude equalized EM resonant cavity bandpass filter having a fourth degree of freedom for providing passband amplitude equalization that is smaller, lighter weight, lower loss and less costly to produce than known bandpass filters having 4-degrees of freedom.

This is accomplished with a bandpass filter that includes a plurality of resonant cavities having respective Qs where at least one of the Qs is different. A plurality of main couplings couple successive resonant cavities to establish a main signal path that provides a first degree of freedom for controlling the shape of the filter's frequency response over its passband. A plurality of bridge couplings couple pairs of the resonant cavities so that the cavities are connected in a canonical circuit topology. The bridge couplings provide second and third degrees of freedom for controlling the sharpness of the frequency response's transition between its passband and stopband and controlling the linearity of its phase, respectively. The cavities' non-uniform Qs provide a fourth degree of freedom for controlling the amplitude of the filter's frequency response in its passband so that the amplitude is within a predetermined tolerance of a desired passband shape.

For a better understanding of the invention, and to show how the same may be carried into effect, reference will now be made, by way of example, to the accompanying drawings.

DETAILED DESCRIPTION OF THE INVENTION

Figure 4:
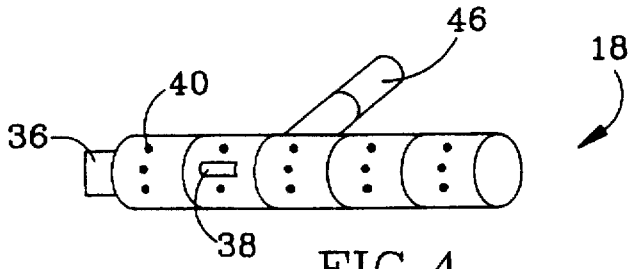
FIG.4 (Prior Art)
FIG. 4, described above, is a perspective view of 4-degree of freedom bandpass filter including an external amplitude equalizer.

In the present invention, the bandpass filter's fourth degree of freedom k is provided by allowing the Qs of the individual resonant cavities to vary and take values less than the selected optimum Q. The Q non-uniformity perturbs the signal as it propagates through the filter in a manner that produces zeros in the passband. The number of passband zeros is equal to the number of cavities whose Q values are less than the optimum Q. This eliminates the need for the external amplitude equalizer 46 shown in FIG. 4. Further, the increase in ohmic loss caused by using sub-optimum Qs is more than offset by the reduction in size, weight, insertion loss and cost.

Figure 1:
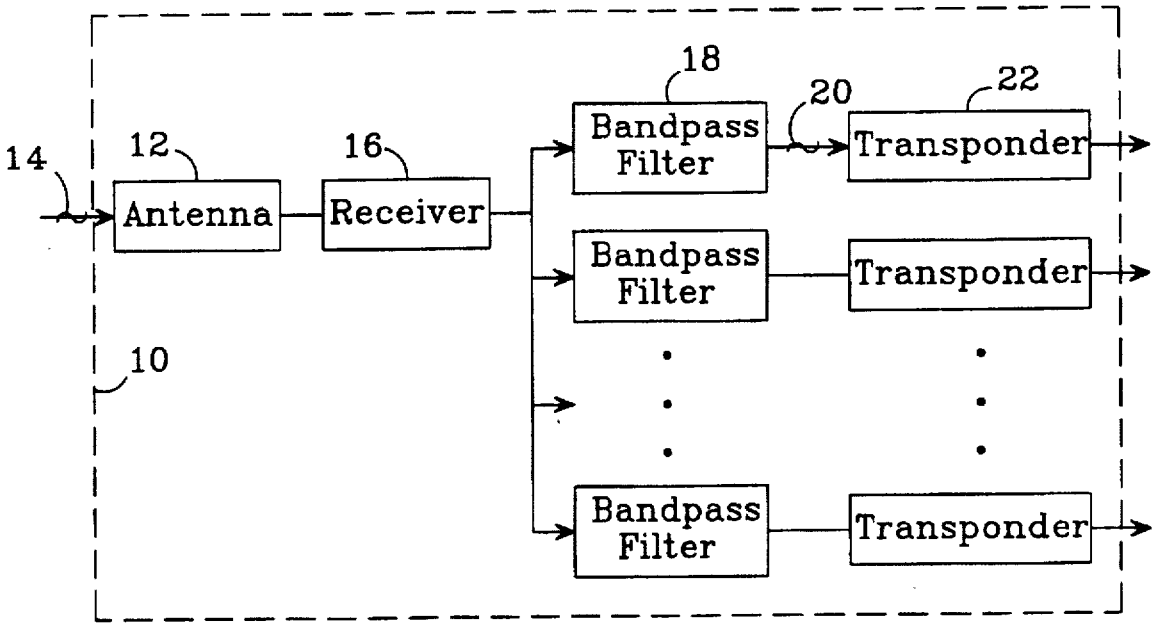
FIG. 1 (Prior Art)
FIG. 1, described above, is a block diagram of a satellite communication system.
Figure 2:
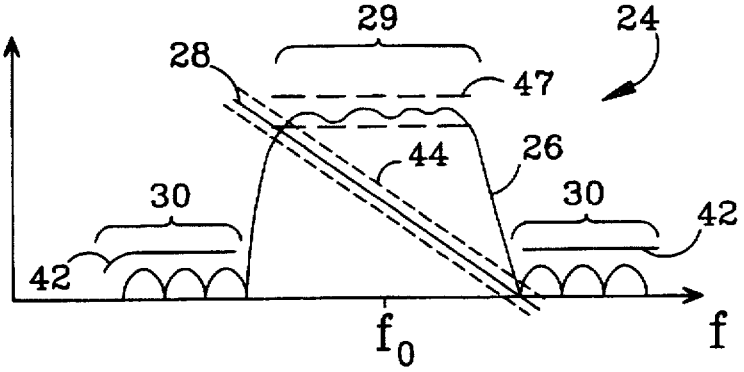
FIG. 2 (Prior Art)
FIG. 2, described above, is a plot of a bandpass filter's frequency response.
Figure 5:
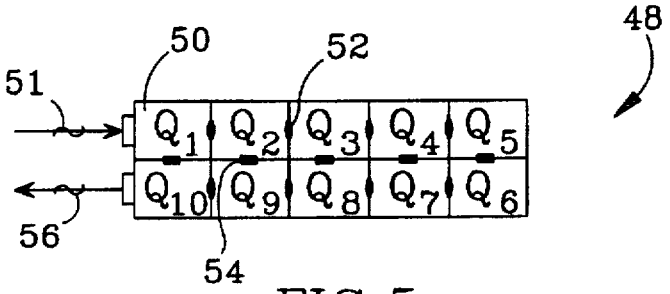
FIG. 5 is a simplified schematic of a 4-degree of freedom bandpass filter connected in a canonical circuit topology and having non-uniform Q in accordance with the present invention.

As shown in FIG. 5, an integrated bandpass filter 48 having 4-degrees of freedom is realized by connecting the filter's resonant cavities 50 in the well known canonical circuit topology to provide 3-degrees of freedom (n,l,m) and, in accordance with the invention, selecting non-uniform Qs ($Q_1, Q_2, \ldots Q_n$) to provide the fourth degree of freedom k. A broadband signal 51 is input coupled to the first cavity, propagates electromagnetically through main couplings 52 (apertures) between successive cavities as it is perturbed by bridge couplings 54, and is output coupled as a narrowband signal 56. In addition, as the signal propagates through the cavities 50 it is further perturbed by the non-uniform Qs of the cavities. This produces the passband zeros as shown in FIG. 2 and reduces the amplitude distortion in the passband.

Figure 3:
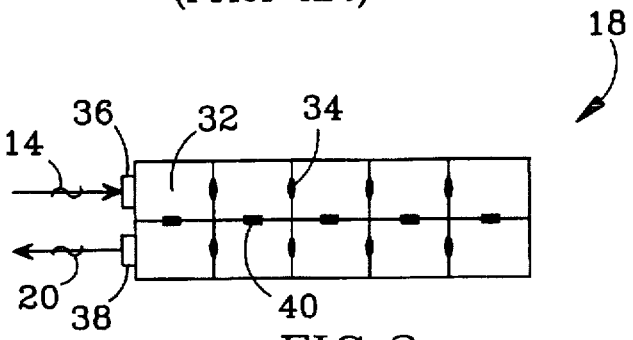
FIG. 3 (Prior Art)
FIG. 3, described above, is a simplified schematic of the bandpass filter connected in a canonical circuit topology.

The bandpass filter 48 is designed for a particular application using the same numerical programming techniques as are used to design the filter 18 that has 3-degrees of freedom as shown in FIG. 3. The only difference is that instead of fixing an optimum value of Q for all resonant cavities, the Qs are variables that can take any value equal to or less than the optimum Q. Thus, in addition to providing the center frequency $f_0$, bandwidth $\Delta f$, the stopband tolerance 42, the return loss, the phase linearity tolerance 44 and the optimum Q as inputs to the program, the user also provides the desired amplitude tolerance 47 (shown in FIG. 2) as an input. The program solves the optimization problem and outputs the number of resonators n, number of bridges 1 and m, and the number of zeros in the pass band k. The program also indicates which cavities have different Qs and what their Qs should be to create the passband zeros.

The geometry and conductivity for those cavities 50, if any, having Qs that equal the optimum Q are determined in the same manner as described previously for the known filter having 3-degrees of freedom. The magnitude of Q for the remaining cavities can be reduced by either adjusting the cavity geometry (size, volume, cross-section) or by reducing the conductivity of the cavities' inner walls. This can be done by using a material such as copper, aluminum or nickel that is less conductive than silver.

Figure 6:
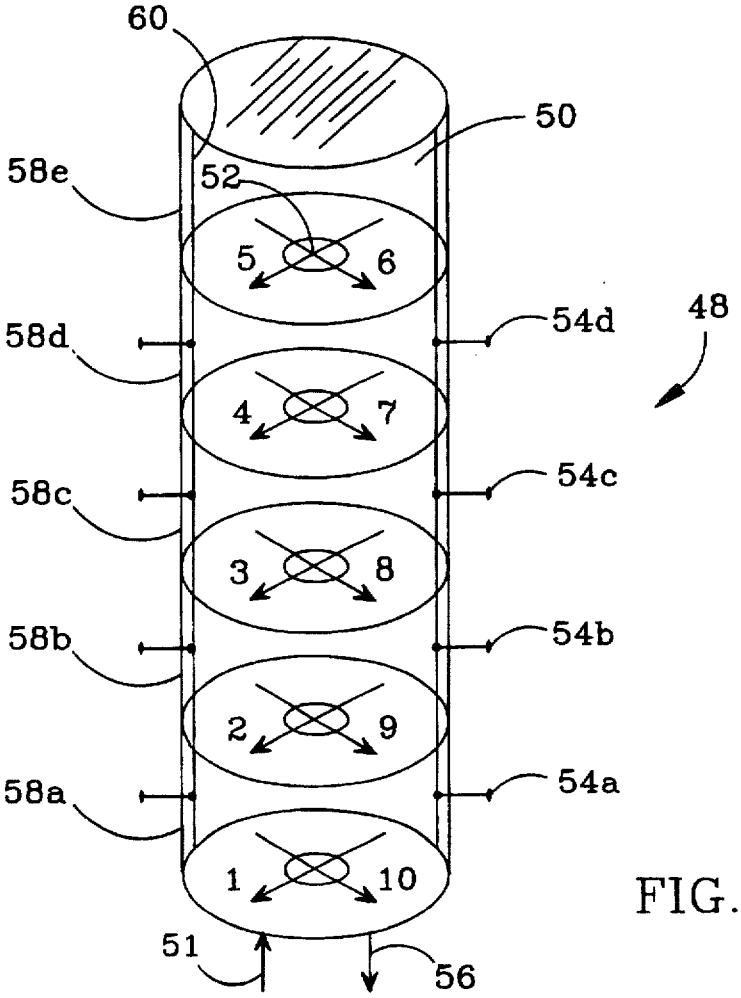
FIG. 6 is a perspective view of the bandpass filter shown in FIG. 5 for a particular application.

FIG. 6 shows a preferred dual-mode implementation of bandpass filter 48 having a center frequency of approximately 12 GHz, a bandwidth of approximately 36 MHz, stopband rejection of 40 dB, minimum return loss of 24 dB, phase linearity (group delay) tolerance of approximate 2 ns, optimum Q of 12,000 and an amplitude tolerance of approximately 0.5 dB. Given these constraints, the numerical optimization program returned values of n=10, l=4, m=4 and k=2. The program also specifies that the second to the last cavity has a reduced Q of 8,000. Because the filter 48 is a dual-mode filter, the 10 cavities are implemented with five resonators 58*a*–58*e* that are coupled via apertures 52. The canonical circuit topology dictates that to provide 1=4 finite frequency loss poles the bridge couplings 54*a* and 54*c* must be provided to properly perturb the signal 48 as it propagates through the filter. Further, bridge couplings 54*b* and 54*d* are adjusted to provide the self delay equalization poles.

In this implementation all the resonators 58*a*–58*e*, and thus cavities, have the same geometry as determined by the optimum Q. To provide maximum conductivity resonators 58*a*–*c* and 58*e* are plated with a lining 60 of silver. In the next to last cavity 58*d*, the lining is formed from nickel, which is less conductive than silver and lowers the Q of cavity 58*d* by approximately 33% to 8,000. Alternately, the geometry of resonator 58*d* could have been changed by varying its diameter and/or length.

Figure 7:
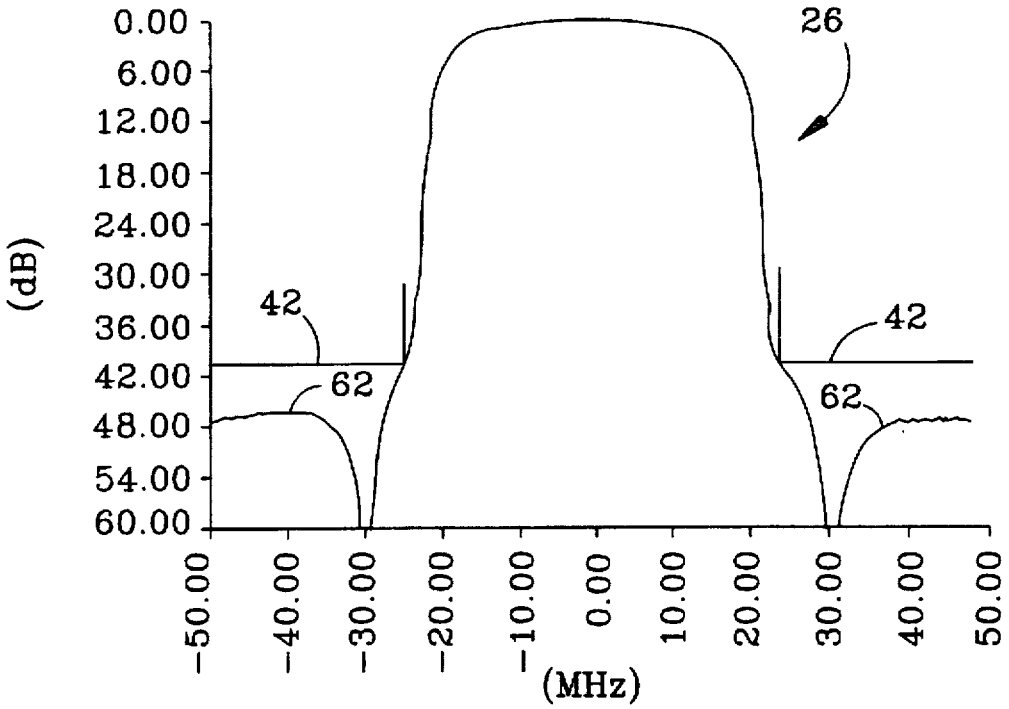
FIGS. 7 through 10 are plots of respectively the out-of-band attenuation, return loss, group delay and passband amplitude for the bandpass filter shown in FIG. 6.

FIG. 7 is a plot of the out-of-band (stopband) attenuation 62 of bandpass filter 48 shown in FIG. 6. The center frequency has been shifted to 0 Hz for the purposes of plotting the frequency response. The stop band includes 4 poles at approximately ±25 MHz and ±30 MHz that sharpen the transition of the frequency response from the passband to the stopband and cause an equiripple effect in the stopband. The out-of-band attenuation is well within the tolerance 42 selected by the user.

Figure 8:
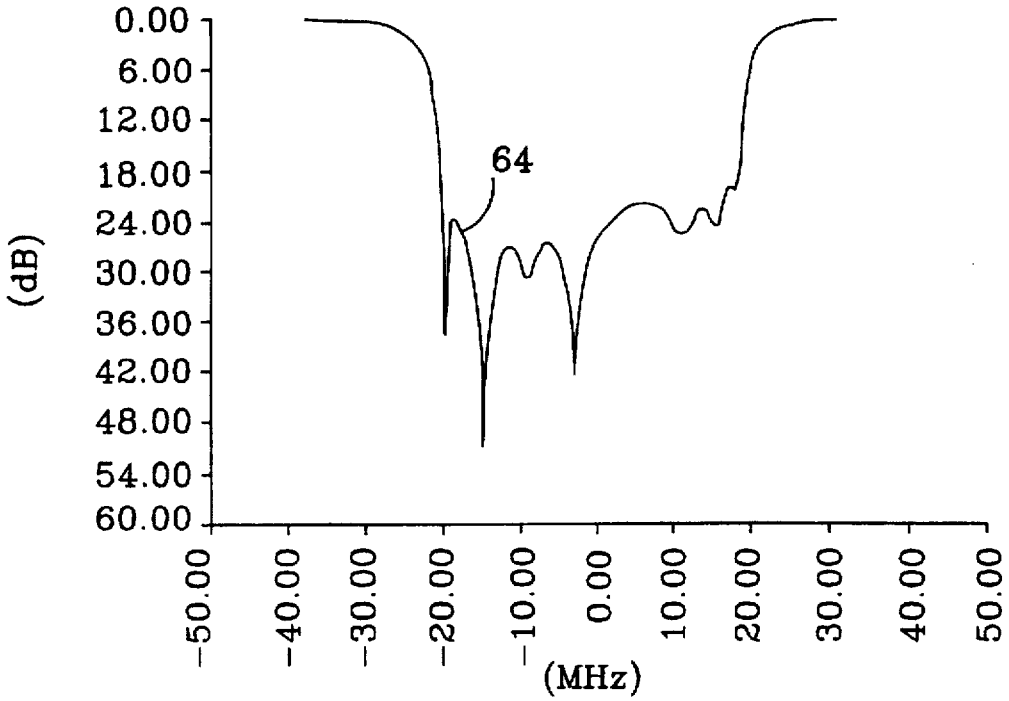

FIG. 8 is a plot of the return loss 64 for bandpass filter 48. In the passband, the reflected signal is reduced by at least 24 dB in the passband as desired. In the stopband almost the entire signal is reflected.

Figure 9:
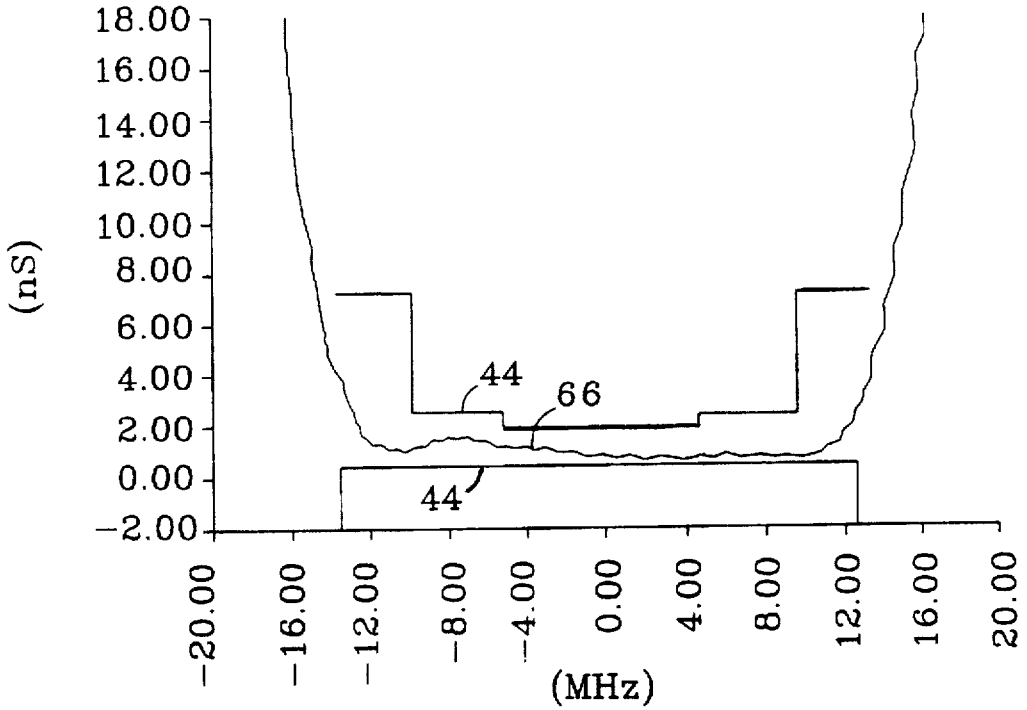

FIG. 9 is a plot of the group delay 66 for bandpass filter 48. The group delay is the first derivative of the phase with respect to frequency, and is used because it is easier to measure. For linear phase, the group delay is constant. Over a majority of the passband the group delay is constant within approximately ±1 ns and increases towards the edges of the passband but remains with the desired tolerance 44.

Figure 10:
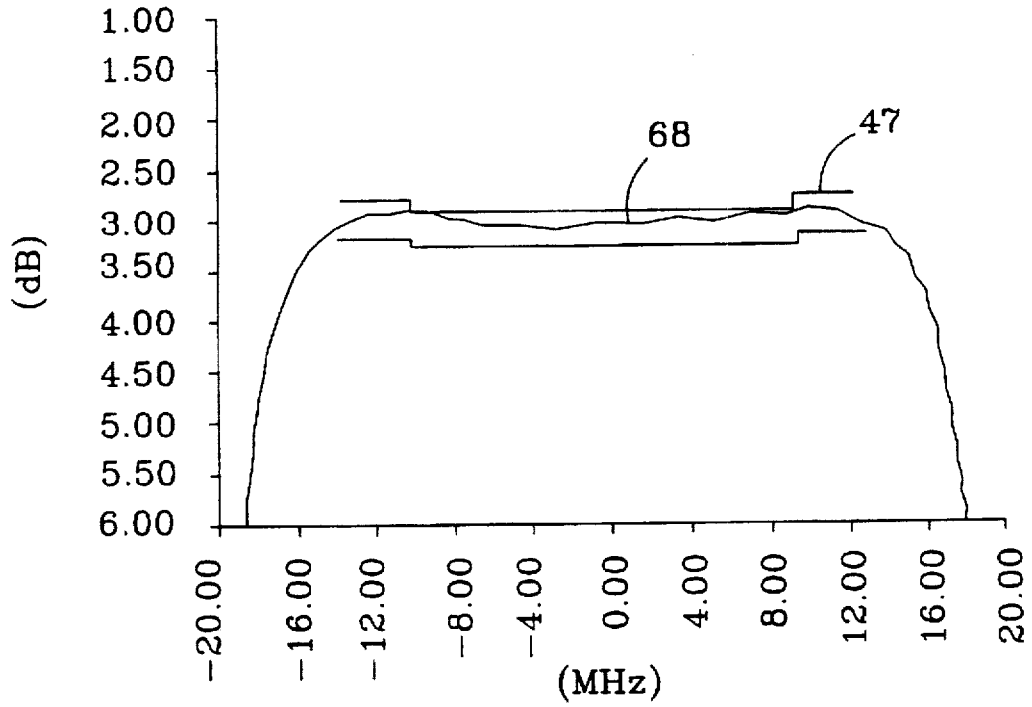

FIG. 10 is a plot of the passband amplitude variation 68 for bandpass filter 48. The amplitude remains relatively flat, within approximately a bound of 0.5 dB, over a majority of the passband. The two zeros occur at approximately ±4 MHz relative to the center frequency. Without these zeros in the passband, whose inclusion are made practical by the present invention, the amplitude would increase monotonically to a high point at the center frequency. Thus, the bound would be significantly larger and the distortion in the narrowband signal would be greater.

While several illustrative embodiments of the invention have been shown and described, numerous variations and alternate embodiment will occur to those skilled in the art. Such variations and alternate embodiments are contemplated, and can be made without departing from the spirit and scope of the invention as defined in the appended claims.

We claim:

1. A bandpass filter having a frequency response that includes a passband, said bandpass filter comprising a plurality of resonant cavities that are connected in a filter topology, said resonant cavities having respective quality factors (Qs) where at least one of said cavities has a selectively degraded fixed Q with respect to other cavities' Qs so that a signal's passband amplitude is internally distorted as the signal propagates through the resonant cavities thereby increasing the filter's ohmic losses and producing the same number of zeros in the filter's passband as there are degraded cavities so that the amplitude of the filter's frequency response in the passband is within a predetermined tolerance of a desired passband shape.

2. The bandpass filter of claim 1, wherein said at least one of said selectively degraded fixed Qs are less than a reference Q value and the remaining Qs are substantially the same as said reference Q value.

3. The bandpass filter of claim 2, wherein said resonant cavities have respective conductivities where the at least one of said resonant cavities that have selectively degraded fixed Qs are less conductive than the remaining cavities which have the substantially the same conductivity.

4. A bandpass filter having a frequency response that includes an amplitude and a phase over a passband and a stopband, comprising:

a plurality of resonant cavities;

a plurality of main couplings that couple successive resonant cavities to establish a main signal path that provides a first degree of freedom for controlling the shape of the amplitude over said passband; and a plurality of bridge couplings that couple pairs of said resonant cavities so that said cavities are connected in a canonical circuit topology, said bridge couplings providing second and third degrees of freedom for controlling the sharpness of the amplitude transition between the passband and the stopband and controlling the linearity of the phase, respectively, said resonant cavities having respective quality factors (Qs) where at least one of said cavities has a Q that is different from the others thereby providing a fourth degree of freedom for controlling the amplitude of the filter's frequency response, said at least one of said cavities having a selectively degraded fixed Q so that a signal's passband amplitude is internally distorted as the signal propagates along the main signal path thereby increasing the filter's ohmic losses and producing the same number of zeros in the filter's passband as there are degraded cavities so that the amplitude is within a predetermined tolerance of a desired passband shape.

5. The bandpass filter of claim 4, wherein said at least one of said selectively degraded fixed Qs are less than a reference Q value and the remaining Qs are substantially the same as said reference Q value.

6. The bandpass filter of claim 5, wherein said resonant cavities have respective conductivities where the at least one of said resonant cavities that have selectively degraded fixed Qs are less conductive than the remaining cavities which have the substantially the same conductivity.

7. A bandpass filter having a frequency response with a passband, comprising:

a plurality of resonant cavities having respective quality factors (Qs), at least one of said cavities having a selectively degraded fixed O with respect to the others;

a plurality of main couplings that couple successive resonant cavities to establish a main signal path that provides a first degree of freedom; and a plurality of bridge couplings that couple pairs of said resonant cavities so that said cavities are connected in a canonical circuit topology to provide second and third degrees of freedom, said at least one of said cavities selectively degraded Qs providing a fourth degree of freedom that increases the filter's ohmic losses, said signal path, bridge couplings and said at least one of said selectively degraded fixed Qs together controlling the filter's frequency response in the four degrees of freedom so that a number of zeros equal to the number of cavities having selectively degraded fixed Os are produced in the filter's passband so that its amplitude and phase are within predetermined tolerances of desired amplitudes and phases, respectively; selectively degraded fixed Qs together controlling the filter's frequency response in the four degrees of freedom so that a number of zeros equal to the number of cavities having selectively degraded fixed Os are produced in the filter's passband so that its amplitude and phase are within predetermined tolerances of desired amplitudes and phases, respectively.

8. The bandpass filter of claim 7, wherein said at least one of said selectively degraded fixed Qs are less than a reference Q value and the remaining Qs are substantially the same as said reference Q value.

9. The bandpass filter of claim 8, wherein said resonant cavities have respective conductivities where the at least one of said resonant cavities that have selectively degraded fixed Qs are less conductive than the remaining cavities which have the substantially the same conductivity.

10. A method of configuring a resonant cavity bandpass filter, comprising:

defining a desired frequency response for the resonant cavity bandpass filter including a desired shape and a tolerance over a passband;

providing a plurality of resonant cavities said resonant cavities having respective quality factors (Qs);

selectively degrading the Q of at least one of said resonant cavities to increase the filter's ohmic loss and produce respective zeros in the filter's passband so that the shape of the filter's frequency response in the passband is within the tolerance of the desired shape; and connecting said resonant cavities in a filter topology.

11. The method of claim 10, wherein the resonant cavities' Qs are selectively degraded by:

defining the Qs of the resonant cavities to be variables;

defining an optimum Q for the resonant cavities; and numerically solving for the values of the Qs to identify which resonant cavities have the optimum Q and which of the at least one said resonant cavities has a degraded Q, and to assign values to the at least one said degraded Q.

12. The method of claim 11, wherein the resonant cavities' Qs are selectively degraded by:

providing the resonant cavities having optimum Qs with the same conductivity; and providing the at least one said resonant cavities having a degraded Q with a reduced conductivity so that its Q is approximately equal to its assigned value.

* * * * *